US011087662B2

(12) United States Patent
Yen

(10) Patent No.: US 11,087,662 B2
(45) Date of Patent: Aug. 10, 2021

(54) DISPLAY CONTROL METHOD FOR TERMINAL SCREEN, DEVICE AND STORAGE MEDIUM THEREOF

(71) Applicant: Beijing Xiaomi Mobile Software Co., Ltd., Beijing (CN)

(72) Inventor: Chiafu Yen, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 0 days.

(21) Appl. No.: 16/699,273

(22) Filed: Nov. 29, 2019

(65) Prior Publication Data

US 2020/0335023 A1 Oct. 22, 2020

(30) Foreign Application Priority Data

Apr. 17, 2019 (CN) ..... 201910309136.3

(51) Int. Cl.
*G09G 3/3208* (2016.01)
*G09G 3/20* (2006.01)
*G09G 5/14* (2006.01)

(52) U.S. Cl.
CPC ..... *G09G 3/20* (2013.01); *G09G 5/14* (2013.01); *G09G 2300/0465* (2013.01); *G09G 2340/0428* (2013.01)

(58) Field of Classification Search
CPC ..... G09G 3/20; G09G 3/3208; G09G 5/14; G09G 5/02; G09G 5/391;
(Continued)

(56) References Cited

U.S. PATENT DOCUMENTS 10,565,724 B2 * 2/2020 Peri ..... G06F 3/011
2002/0044156 A1 * 4/2002 Maezawa ..... G06F 3/14 345/698

(Continued)

FOREIGN PATENT DOCUMENTS

CN 101593469 A 12/2009
CN 105009057 A 10/2015

(Continued)

OTHER PUBLICATIONS

Extended European Search Report in the European Application No. 19218084.2 dated Jun. 18, 2020.

(Continued)

*Primary Examiner* — Michael J Eurice
(74) *Attorney, Agent, or Firm* — Finnegan, Henderson, Farabow, Garrett & Dunner, L.L.P.

(57) ABSTRACT

The present disclosure relates to a display control method for a terminal screen. The terminal screen includes a display layer with an integrated structure, the display layer includes a first display region and a second display region, and a pixel density of the first display region is greater than a pixel density of the second display region. The method includes: controlling a transition region in the first display region to be displayed according to a target pixel density; controlling one or more regions in the first display region other than the transition region to be displayed according to a first pixel density; and controlling the second display region to be displayed according to a second pixel density, wherein the target pixel density is smaller than the first pixel density and greater than the second pixel density.

9 Claims, 8 Drawing Sheets

(58) Field of Classification Search
CPC ... G09G 2300/0465; G09G 2340/0407; G09G 2340/0428; G09G 2320/103; G09G 2310/0232; G09G 2320/0686
See application file for complete search history.

(56) References Cited

U.S. PATENT DOCUMENTS

2002/0149037 A1 10/2002 Shimoda et al.
2003/0231162 A1* 12/2003 Kishi ..... G02F 1/167 345/107
2007/0168413 A1* 7/2007 Barletta ..... G06F 3/04883 709/203
2009/0265661 A1 10/2009 Shuster et al.
2010/0245870 A1* 9/2010 Shibata ..... G06K 9/033 358/1.9
2011/0012828 A1* 1/2011 Nagai ..... G06F 3/016 345/156
2013/0182002 A1* 7/2013 Macciola ..... H04N 1/387 345/589
2013/0194295 A1* 8/2013 Chan ..... G09G 3/3466 345/619
2015/0178953 A1* 6/2015 Gao ..... G06T 7/70 345/681
2015/0237079 A1* 8/2015 Hirata ..... H04M 1/72519 348/14.07
2017/0076654 A1* 3/2017 Wang ..... G09G 3/2074
2017/0212398 A1 7/2017 Cao et al.
2017/0301288 A1* 10/2017 Perdices-Gonzalez ..... G09G 3/2092
2018/0095531 A1* 4/2018 Brown ..... H04N 5/4403
2018/0226012 A1* 8/2018 Sim ..... G06F 1/1601
2019/0163006 A1* 5/2019 Lu ..... G09F 9/301
2019/0293976 A1* 9/2019 Cheng ..... G02F 1/1336
2019/0310724 A1* 10/2019 Yeke Yazdandoost ..... G06F 3/0412
2019/0326366 A1* 10/2019 Fan ..... H01L 27/3244
2020/0098332 A1* 3/2020 Zhang ..... G09G 3/20
2020/0234634 A1* 7/2020 Li ..... G09G 3/3208

FOREIGN PATENT DOCUMENTS

CN 106921767 A 7/2017
CN 107240358 A 10/2017
CN 207947007 U 10/2018
CN 108766347 A 11/2018
CN 208607570 U 3/2019
JP 02073292 A * 3/1990
JP 2015142142 A 8/2015
KR 20170040205 A 4/2017
KR 20170062030 A 6/2017
KR 20170067077 A 6/2017
RU 2343510 C2 1/2009
WO WO 2016/016765 A1 2/2016
WO WO 2017/164680 A1 9/2017

OTHER PUBLICATIONS

Office Action of Russian Application No. 2019139101/07 dated Apr. 20, 2020.
Grant of Patent for counterpart Korean Patent Application No. 10-2019-7028218 dated Nov. 25, 2020.

* cited by examiner

DISPLAY CONTROL METHOD FOR TERMINAL SCREEN, DEVICE AND STORAGE MEDIUM THEREOF

CROSS-REFERENCE TO RELATED APPLICATIONS

The present application is based upon and claims priority to Chinese Patent Application No. 201910309136.3, filed on Apr. 17, 2019, the entire content of which is incorporated herein by reference.

TECHNICAL FIELD

The present disclosure relates to the field of display technologies, and in particular, to a display control method for a terminal screen, a display control device for a terminal screen, and a storage medium of the method.

BACKGROUND

The mobile phone industry has an increasingly high pursuit of screen-to-body ratio, expecting to produce a mobile phone that has a screen-to-body ratio close to 100%.

The difficulty in increasing the screen-to-body ratio is how to properly set functional devices (such as cameras, earpieces, light sensors, distance sensors, fingerprint sensors, etc.) on the front panel of the mobile phone to maximize the screen-to-body ratio. In the related art, a technical idea of setting the above functional devices under the screen of a mobile phone is proposed. By setting the above functional devices under the screen of the mobile phone, the space of the front panel of the mobile phone occupied by these functional devices can be fully released, thereby increasing the screen-to-body ratio.

In order to ensure that these functional devices can still work normally after being disposed under a terminal screen, the terminal screen is designed to include two different display regions, such as a first display region and a second display region, wherein the above functional devices are disposed under the second display region, and the second display region and the first display region have different manufacturing attributes (including pixel density, light transmittance performance, etc.). For example, the pixel density of the second display region is smaller than the pixel density of the first display region, so that the light transmittance performance of the second display region is better than the light transmittance performance of the first display region, thereby ensuring that optical devices such as the camera and the light sensor can work normally when being disposed under the screen.

However, since the first display region and the second display region of the terminal screen have different manufacturing attributes, the display effects of the two display regions are different either, resulting in that the display effect of the entire screen is not inosculated as a whole.

SUMMARY

According to a first aspect of an embodiment of the present disclosure, there is provided a display control method for a terminal screen, wherein the terminal screen includes a display layer with an integrated structure, the display layer includes a first display region and a second display region, and a pixel density of the first display region is greater than a pixel density of the second display region, the method comprising: controlling a transition region in the first display region to be displayed according to a target pixel density, wherein the transition region is a neighboring region in the first display region and is adjacent to the second display region; controlling one or more regions in the first display region other than the transition region to be displayed according to a first pixel density; and controlling the second display region to be displayed according to a second pixel density, wherein the target pixel density is smaller than the first pixel density and greater than the second pixel density.

According to a second aspect of the embodiments of the present disclosure, there is provided a display control device for a terminal screen, wherein the terminal screen includes a display layer with an integrated structure, the display layer includes a first display region and a second display region, and a pixel density of the first display region is greater than a pixel density of the second display region, the device comprising: a processor; and a memory for storing instructions executable by the processor; wherein the processor is configured to: control a transition region in the first display region to be displayed according to a target pixel density, wherein the transition region is a neighboring region in the first display region and is adjacent to the second display region; control one or more regions in the first display region other than the transition region to be displayed according to a first pixel density; and control the second display region to be displayed according to a second pixel density, wherein the target pixel density is smaller than the first pixel density and greater than the second pixel density.

According to a third aspect of an embodiment of the present disclosure, there is provided a non-transitory computer readable storage medium having stored thereon a computer program that, when executed by a processor of a device, cause the device to perform the display control method in the first aspect.

The technical solutions provided by the embodiments of the present disclosure may include the following beneficial effects:

By providing the transition region in the first display region having a higher pixel density, the transition region, one or more regions in the first display region other than the transition region, and the second display region are controlled to be displayed according to the target pixel density, the first pixel density and the second pixel density, respectively, wherein the target pixel density is smaller than the first pixel density and greater than the second pixel density, such that the difference between the display effects caused by the difference in pixel densities of the first display region and the second display region can be effectively reduced, and the fusion of the display effects of the two display regions is improved, thereby making the overall display effect of the terminal screen better.

It should be noted that the above general description and the following detailed description are intended to be illustrative and not restrictive.

BRIEF DESCRIPTION OF THE DRAWINGS

The accompanying drawings, which are incorporated in the specification and constitute a part of the specification, show exemplary embodiments of the present disclosure. The drawings along with the specification explain the principles of the present disclosure.

DETAILED DESCRIPTION

Exemplary embodiments will be described in detail herein, examples of which are illustrated in the accompanying drawings. The following description refers to the same or similar elements in the different figures unless otherwise indicated. The embodiments described in the following exemplary embodiments do not represent all embodiments consistent with the present invention. Instead, they are merely examples of devices and methods consistent with aspects of the present invention as detailed in the appended claims.

Figure 1:
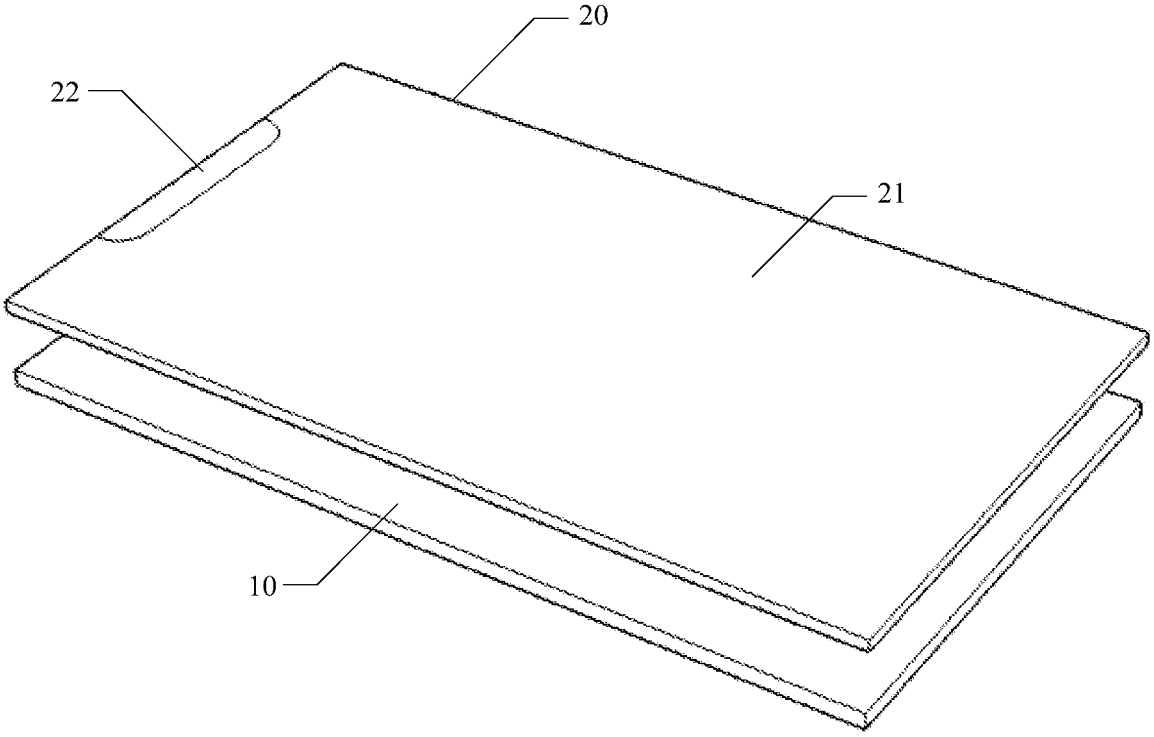
FIG. 1 is a schematic diagram of a terminal screen according to an exemplary embodiment.

FIG. 1 is a schematic diagram of a terminal screen according to an embodiment. As shown in FIG. 1, the terminal screen includes a display layer 20 with an integrated structure. The display layer 20 includes a first display region 21 and a second display region 22, and a pixel density of the first display region 21 is greater than a pixel density of the second display region 22.

The display layer 20 is configured to implement a display function of the terminal screen. The first display region 21 and the second display region 22 are each provided with the display function. The number of the second display regions 22 may be one or plural. In FIG. 1, it is assumed that the number of the second display regions 22 is one for illustrative purpose.

In the embodiment, the display layer 20 includes two different types of display regions, that is, the first display region 21 and the second display region 22, and the first display region 21 and the second display region 22 are a unified whole in physical structure, that is, the display layer 20 is an integrated structure that is not divided into a plurality of mutually independent components. There is no stitching gap in the display layer 20.

If the display layer 20 includes a plurality of mutually independent components, and the components are stitched to form the display layer 20, there must be a certain gap at the stitching position, which may lead to gaps between display contents of the respective components, thus it may not realize the display effect that the display content of the whole display layer 20 is inosculated as a whole without gap.

In the embodiment, since the display layer 20 is an integrated structure, there is no stitching gap in the display layer 20, thus there is no gap between the display content of the first display region 21 and the display content of the second display region 22, thereby realizing the display effect that the display content of the whole display layer 20 is inosculated as a whole without gap.

In the embodiment, the pixel density of the first display region 21 is greater than the pixel density of the second display region 22. The pixel density may refer to the number of pixels (or sub-pixels) contained in a unit area, and the pixel density may be referred to as resolution or screen resolution as well. The pixel density is usually expressed in ppi (pixels per inch). In some embodiments, the pixel density can be expressed in ppc (pixels per centimeter) as well. For example, the pixel density of the first display region 21 is 400 ppi, and the pixel density of the second display region 22 is 200 ppi.

Figure 2:
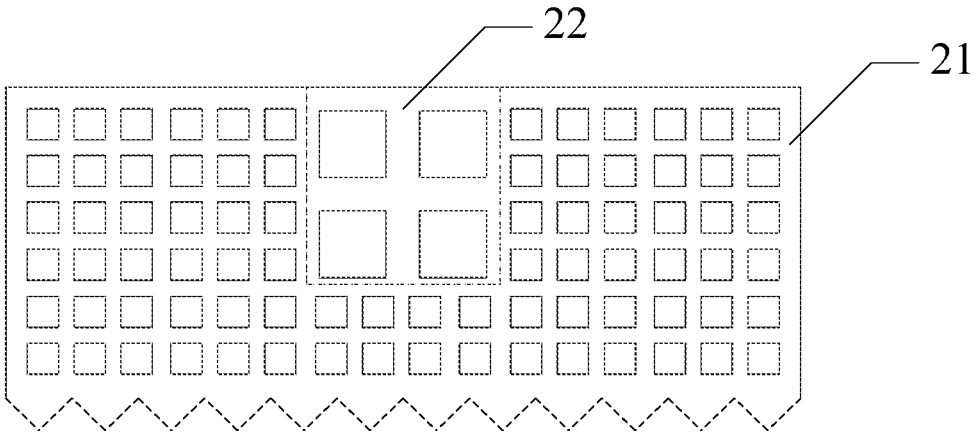
FIG. 2 is a schematic diagram showing a difference in pixel density between a first display region and a second display region, according to an exemplary embodiment.

In an embodiment, shown in FIG. 2, the pixel density of the first display region 21 is greater than the pixel density of the second display region 22. For example, the pixel density of the first display region 21 is 2 times, 3 times, 1.6 times or any other values greater than 1 time the pixel density of the second display region 22, which is not limited in the embodiment of the present disclosure. In addition, the position relationship between the first display region 21 and the second display region 22 includes, but is not limited to, any one of the following: the first display region 21 is provided on the left and right sides of the second display region 22, the first display region 21 is provided on the upper, lower, left and right sides of the second display region 22, the first display region 21 is only provided on the right or left side of the second display region 22, and the first display region 21 is provided on the right, left and lower sides of the second display region 22, and so on.

Since the pixel density of the first display region 21 is greater than the pixel density of the second display region 22, the light transmittance performance of the second display region 22 is better than that of the first display region 21. The optical device may be disposed under the second display region 22. The optical device is a functional device that needs to receive and/or emit light during operation, such as a camera, a light sensor, a distance sensor, an infrared emitter, an infrared receiver, and the like.

In the embodiment, the shape of the area of the second display region 22 is not limited, and may be a regular shape such as a rectangle, a rounded rectangle, a circle, or the like, or may be an irregular shape such as a drop shape, an arc shape, or the like. In addition, in the embodiment, the size of the second display region 22 is not limited, and it may be designed according to actual needs (such as functional devices that need to be disposed under the second display region 22). For example, the second display region 22 can be a rectangular region of 3 mm×2 mm, which can include 48×32 pixels.

In an embodiment, the terminal screen has a regular shape, and the regular shape includes any one of the following: a rectangle, a rounded rectangle, and a circle. In another embodiment, the terminal screen may also have an irregular shape, which is not limited in the disclosure.

In addition, as shown in FIG. 1, the terminal screen may further include a substrate 10 on which the display layer 20 is disposed. The substrate 10 may include a first substrate region under the first display region 21 and a second substrate region under the second display region 22. The projection region of the first display region 21 on the substrate 10 is the first substrate region; and the projection region of the second display region 22 on the substrate 10 is the second substrate region. The substrate 10 serves to support the display layer 20.

In addition, there is no opening on the terminal screen in the embodiment. No opening is provided in both the first display region 21 and the second display region 22. Since the functional devices such as the camera and the sensor can be disposed under the terminal screen, it is not necessary to place the functional devices through an opening in the terminal screen; and, since the light transmittance performance of the second display region 22 is better than that of the first display region 21, the optical device can operate normally by disposing the optical device under the second display region 22, and it is not necessary to improve the light transmittance performance through an opening in the terminal screen. Therefore, the display content of both the first display region 21 and the second display region 22 does not have a defect due to the opening. Taking the terminal screen shown in FIG. 1 as an example, the shape of the area of the entire display layer 20 formed by combining the first display region 21 and the second display region 22 is a rectangle, therefore, the display content of the entire display layer 20 formed by combining the display content of the first display region 21 and the display content of the second display region 22 is a rectangular picture, and in the rectangular picture, there is no defect caused by an opening, and no gap either.

Further, the terminal screen may include a touch sensing layer and a cover glass in addition to the substrate 10 and the display layer 20 described above. The touch sensing layer is located above the display layer 20, and the glass cover is located above the touch sensing layer. The touch sensing layer is used to implement a touch sensing function, such as detecting a user's finger click, slide, press, and the like. The glass cover is used to provide protection for the terminal screen and extend the life of the screen.

The terminal screen in the embodiment may be an LCD (Liquid Crystal Display) screen or an OLED (Organic Light-Emitting Diode) screen. When the terminal screen is an OLED screen, it may be a flexible screen or a non-flexible screen.

In addition, a terminal may include one terminal screen provided by the present disclosure, and may include a plurality of terminal screens provided by the present disclosure, or may include one or more terminal screens provided by the present disclosure and one or more of existing terminal screens, which is not limited in the embodiment of the present disclosure.

For the terminal screen provided by the above embodiment, since its display layer includes the first display region and the second display region having different pixel densities, the display effects of the first display region and the second display region may be different. For example, the pixel particle sensation in the second display region is relatively heavier than that of the first display region, and the boundary line between the first display region and the second display region is conspicuous. The embodiment of the present disclosure provides a display control method for the terminal screen, by which, the difference between the display effect of the first display region and that of the second display region can be effectively reduced, and the fusion of the display effects of the two display regions can be improved, thereby making the overall display effect of the terminal screen better.

Figure 3:
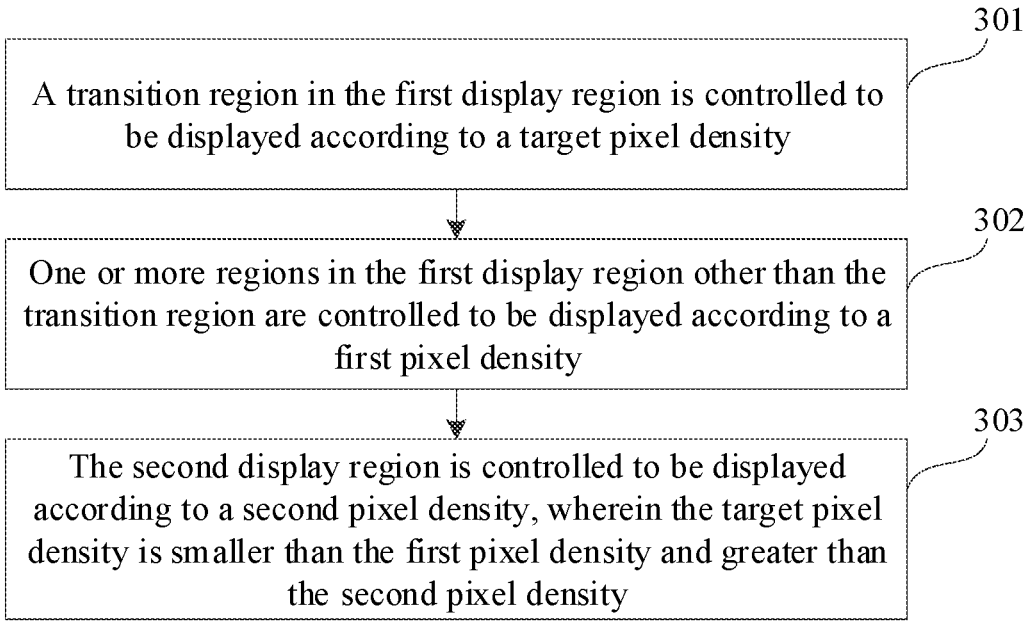
FIG. 3 is a flowchart of a display control method for a terminal screen according to an exemplary embodiment.

FIG. 3 is a flowchart of a display control method for a terminal screen according to an exemplary embodiment. The method can be applied to a terminal, and the terminal can be an electronic device such as a mobile phone, a tablet computer, an e-book reader, a multimedia playing device, a wearable device, an in-vehicle terminal, or the like. The terminal includes the terminal screen as provided in the embodiment of FIG. 1. The method can include the following steps.

In step 301, a transition region in the first display region is controlled to be displayed according to a target pixel density;

In step 302, one or more regions in the first display region other than the transition region are controlled to be displayed according to a first pixel density;

In step 303, the second display region is controlled to be displayed according to a second pixel density, wherein the target pixel density is smaller than the first pixel density and greater than the second pixel density.

In an embodiment, the transition region is a neighboring region, which is located in the first display region and is adjacent to the second display region. For example, the pixels included in the transition region are pixels in the first display region, whose shortest distance from the second display region is less than a preset threshold. The shortest distance between a certain pixel in the first display region and the second display region may refer to the distance between the center point of the pixel and the target point in the second display region, wherein the target point may refer to the point in the second display region that is closest to the center point of the pixel.

Figure 4:
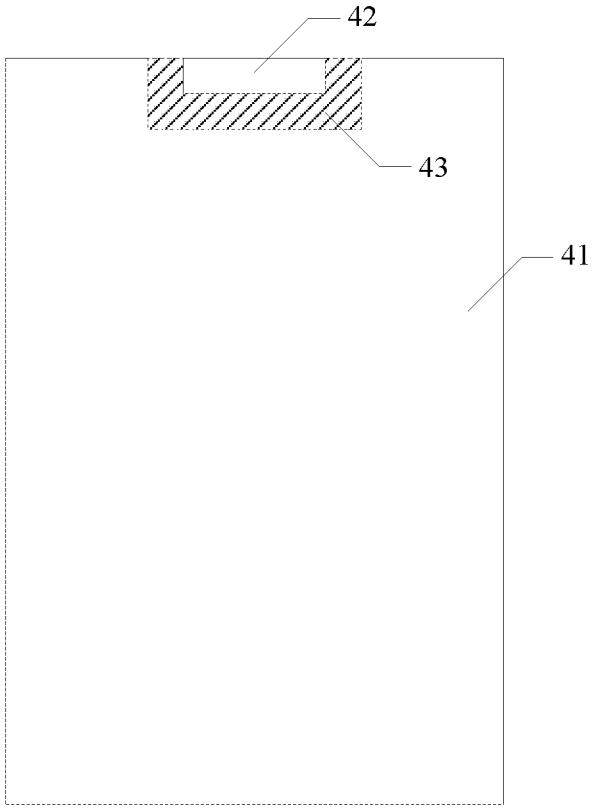
FIG. 4 is a schematic diagram showing a transition region, according to an exemplary embodiment.

In an embodiment, the transition region includes a plurality of pixels surrounding the second display region. For example, as shown in FIG. 4, the terminal screen includes a first display region 41 and a second display region 42. A transition region 43 in the first display region 41 is shown as a hatched portion in FIG. 4, surrounding the second display region 42.

Figure 5:
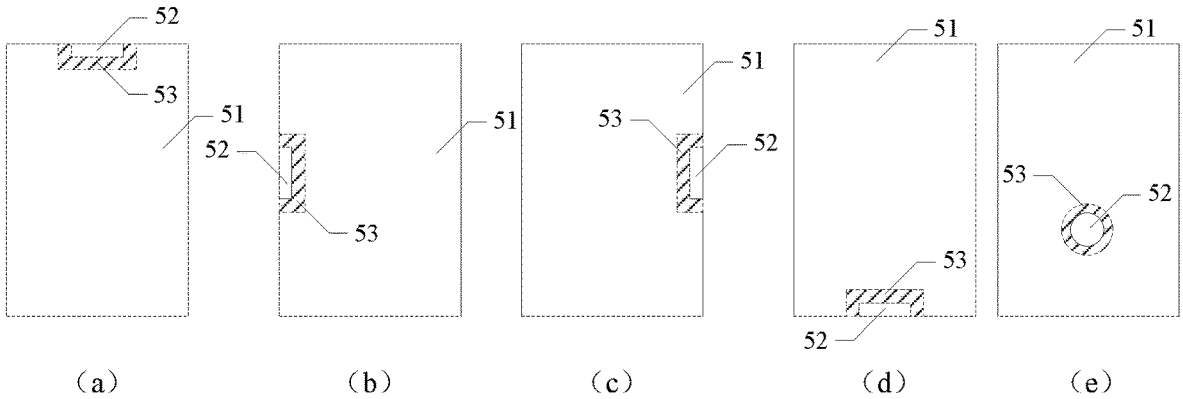
FIG. 5 is schematic diagrams showing positional relationships between a first display region and a second display region, according to an exemplary embodiment.

In addition, the second display region may be located at a notch portion formed at a side edge of the first display region; or the second display region may be located at a notch portion formed at the middle of the first display region. As shown in FIG. 5, schematic diagrams of several positional relationships between a first display region and a second display region are exemplarily shown. As shown in part (a) of FIG. 5, the second display region 52 is located at a notch portion formed at the top edge of the first display region 51, and the transition region 53 (shown by the oblique line filling portion) in the first display region 51 surrounds the second display regions 52. As shown in part (b) of FIG. 5, the second display region 52 is located at a notch portion formed at the left edge of the first display region 51, and the transition region 53 (shown by the oblique line filling portion) in the first display region 51 surrounds the second display region 52. As shown in part (c) of FIG. 5, the second display region 52 is located at a notch portion formed at the right edge of the first display region 51, and the transition region 53 (shown by the oblique line filling portion) in the first display region 51 surrounds the second display region 52. As shown in part (d) of FIG. 5, the second display region 52 is located at a notch portion formed at the bottom edge of the first display region 51, and the transition region 53 (shown by the oblique line filling portion) in the first display region 51 surrounds the second display regions 52. As shown in part (e) of FIG. 5, the second display region 52 is located at a notch portion formed in the middle of the first display region 51, and the transition region 53 (shown by the oblique line filling portion) in the first display region 51 surrounds the second display region 52.

In the embodiment, the transition region is provided in the first display region of a higher pixel density, and the transition region, the one or more regions other than the transition region in the first display region, and the second display region are controlled to be displayed according to the target pixel density, the first pixel density, and the second pixel density, respectively, wherein the target pixel density is less than the first pixel density and greater than the second pixel density. For example, the first pixel density is 400 ppi and the second pixel density is 200 ppi, the target pixel density can be 300 ppi, such that the difference between the display effects caused by the difference in pixel densities of the first display region and the second display region can be effectively reduced, and the fusion of the display effects of the two display regions can be improved, thereby making the overall display effect of the terminal screen better.

In an exemplary embodiment, each sub-region in the transition region has the same pixel density, which is the target pixel density. In another embodiment, the target pixel density is an average of the first pixel density and the second pixel density.

In an embodiment, the terminal controls n pixels in the transition region not to be displayed so as to control the transition region to display according to the target pixel density, where n is an integer greater than 1. For example, by powering down a pixel, the pixel can be made not to be displayed. For another example, by assigning a value of 0 to the RGB value of the pixel, the pixel is not displayed. In an embodiment, n pixels are evenly distributed in the transition region. For example, the pixel density of the first display region is 400 ppi, and the pixel density of the second display region is 200 ppi, and it is assumed that it is needed to control the transition region to display at 300 ppi, every 4 pixels in the transition region can be powered down by 1 pixel. By controlling a portion of the pixels in the transition region not to be displayed, the purpose of reducing the screen resolution of the transition region can be realized, such that the pixel density difference between the first display region and the second display region transitions more smoothly.

In an exemplary embodiment, the transition region includes k sub-regions, and distances between the k sub-regions and the second display region are gradually increased, wherein k is an integer greater than one. A sub-region of the transition region may refer to a partial region being a portion of the transition region, the sub-region having a size smaller than the size of the transition region, and the sub-region is located in the transition region. In addition, the distance between the sub-region and the second display region may refer to a distance between a central pixel of the sub-region and a central pixel of the second display region.

Figure 6:
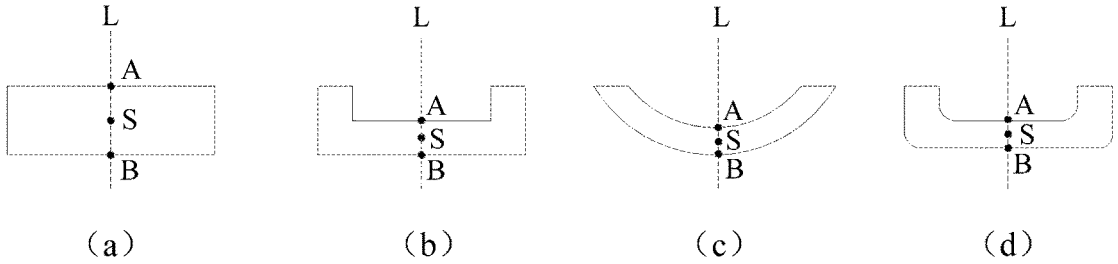
FIG. 6 is schematic diagrams showing central pixels of sub-regions, according to an exemplary embodiment.

The central pixel of the sub-region may refer to a pixel located in the center of the sub-region. Generally, the sub-region is axisymmetric, and the central pixel of the sub-region is the midpoint of the line segment formed by the symmetry axis of the sub-region intersecting the edges of the sub-region. For example, as shown in part (a) of FIG. 6, when the sub-region is rectangular, the symmetry axis L intersects the two sides of the sub-region to form a line segment AB, and the midpoint S of the line segment AB is the center pixel of the sub-region. For other examples, as shown in parts (b), (c), and (d) of FIG. 6, when the sub-region is ring-shaped or similarly ring-shaped, the axis of symmetry L intersects the edges of the sub-region to form a line segment AB, and the midpoint S of the line segment AB is the central pixel of the sub-region.

Figure 7:
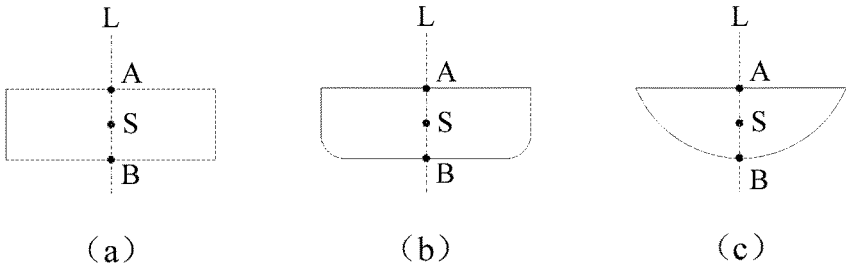
FIG. 7 is schematic diagrams showing central pixels of second display regions, according to an exemplary embodiment.

The central pixel of the second display region may refer to a pixel located at the center of the second display region. Generally, the second display region is axisymmetric as well, and the central pixel of the second display region is the midpoint of the line segment formed by the symmetry axis of the second display region intersecting the edges of the second display region. For example, as shown in part (a) of FIG. 7, when the second display region is rectangular, the axis of symmetry L intersects the two sides of the second display region to form a line segment AB, and the midpoint S of the line segment AB is the central pixel of the second display region. For another example, as shown in part (b) of FIG. 7, when the second display region is a rectangular shape, the axis of symmetry L intersects with two sides of the second display region to form a line segment AB, and the midpoint S of the line segment AB is the central pixel of the second display region. For further another example, as shown in part (c) of FIG. 7, when the second display region is semicircular or cut circular, the axis of symmetry L intersects with two sides of the second display region to form a line segment AB, the midpoint S of the line segment AB is the central pixel of the second display region.

In an embodiment, the terminal controls the k sub-regions to be displayed according to different pixel densities, wherein a pixel density of the i-th sub-region of the k sub-regions is smaller than a pixel density of the (i+1)th sub-region, and i is a positive integer smaller than k. Accordingly, the closer the sub-region is close to the second display region, the smaller the pixel density of the sub-region is, and the farther the sub-region is distant from the second display region, the larger the pixel density of the sub-region is.

Figure 8:
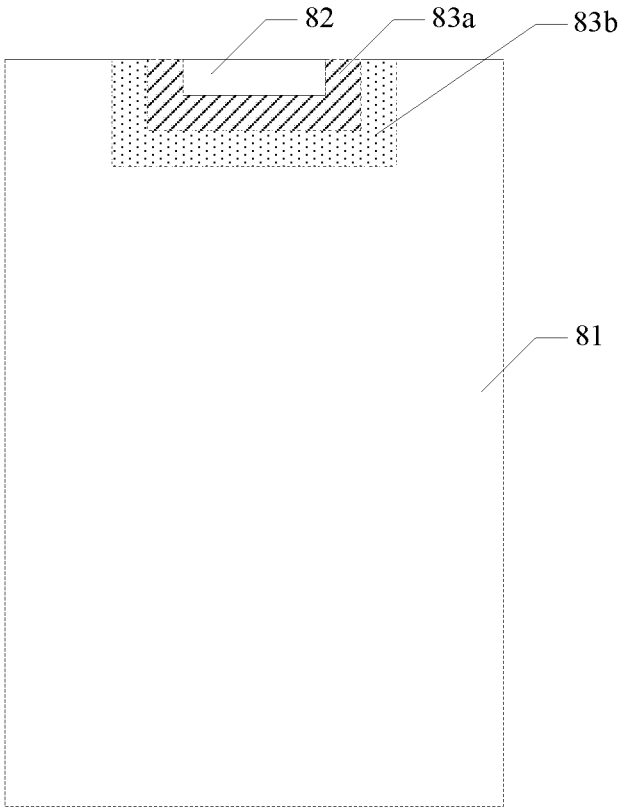
FIG. 8 is a schematic diagram showing a transition region, according to an exemplary embodiment.

For example, as shown in FIG. 8, the terminal screen includes a first display region 81 and a second display region 82, and the transition region in the first display region 81 includes a first sub-regions 83*a* (shown as a hatched portion in FIG. 8) and a second sub-region 83*b* (shown as a black dot fill portion in FIG. 8) in FIG. 8. It is assumed that the pixel density of the first display region 81 is the first pixel density and the pixel density of the second display region 82 is the second pixel density, then, the second pixel density is smaller than the pixel density of the first sub-region 83*a*, the pixel density of the first sub-region 83*a* is smaller than the pixel density of the second sub-region 83*b*, and the pixel density of the second sub-region 83*b* is smaller than the first pixel density.

In the above manner, the transition region is divided into a plurality of sub-regions, and the pixel density of each sub-region is flexibly set. The closer the sub-region is close to the second display region, the smaller the pixel density of the sub-region is, and the farther the sub-region is distant from the second display region, the larger the pixel density of the sub-region is, which can further improve the smoothness of the pixel density change, making the display effect of the entire terminal screen more inosculated and natural.

In the embodiment, the number of sub-regions included in the transition region is not limited, and the number may be a fixed value set in advance, or may be a non-fixed value determined in real time according to actual conditions. The larger the number is, the smaller the pixel density variation between adjacent regions is, such that the difference in display effect between adjacent regions is smaller.

In addition, the transition region may be a preset size-fixed region, or may be a size-unfixed region determined in real time according to actual conditions. In an embodiment, the terminal determines the size of the transition region according to the degree of difference between the content to be displayed in the first display region and the content to be displayed in the second display region, wherein the size of the transition region is positively correlated with the degree of difference.

For example, the terminal may determine the size of the transition region according to the degree of difference in brightness and/or color of the content to be displayed in the two display regions. The greater the degree of difference is, the larger the size of the transition region is; conversely, the smaller the degree of difference is, the smaller the size of the transition region is. In the above manner, the display effect difference of the first display region and the second display region can be transited more smoothly. Further, in combination with the above-described division of the transition region into a plurality of sub-regions, and the solution that the closer the sub-region is close to the second display region, the smaller the pixel density of the sub-region is, the farther the sub-region is distant from the second display region, the larger the pixel density of the sub-region is, when the difference between the content to be displayed in the first display region and that in the second display region is large, enough transition regions can be reserved to gradually fade the difference.

It should be noted that, in the embodiment, the execution order of the foregoing steps 301, 302 and 303 is not limited. For example, the foregoing steps 301, 302 and 303 may be performed simultaneously. When the terminal screen needs to display a picture frame, the terminal controls the transition region in the first display region to display the first partial region in the picture frame according to the target pixel density, and controls one or more regions in the first display region other than the transition region to display a second partial region in the picture frame according to a first pixel density, and, at the same time, controlling the second display region to display a third partial region in the picture frame according to the second pixel density. The first partial region, the second partial region, and the third portion region forms a complete picture frame without stitching gaps.

In addition, the terminal may use the display control method provided in the above steps 301-303 to control the display of the terminal screen when displaying any one of the picture frames; or may use the above steps only when displaying the picture frames that meet a preset condition, and when displaying the picture frames that do not meet the preset condition, directly control the first display region to display according to the first pixel density and control the second display region to display according to the second pixel density. In an embodiment, the picture frame meeting the preset condition may refer to a picture frame in which the picture content in a target region of the terminal screen is of the same color, and the target region may refer to an region including the second display region and having a size larger than the second display region.

In the embodiment, by providing the transition region in the first display region having a higher pixel density, the transition region, one or more regions in the first display region other than the transition region, and the second display region are controlled to be displayed according to the target pixel density, the first pixel density and the second pixel density, respectively, wherein the target pixel density is smaller than the first pixel density and greater than the second pixel density, such that the difference between the display effects caused by the difference in pixel densities of the first display region and the second display region can be effectively reduced, and the fusion of the display effects of the two display regions is improved, thereby making the overall display effect of the terminal screen better.

In addition, the transition region is divided into a plurality of sub-regions, and the pixel density of each sub-region is flexibly set. The closer the sub-region is close to the second display region, the smaller the pixel density of the sub-region is, and the farther the sub-region is distant from the second display region, the larger the pixel density of the sub-region is, which can further improve the smoothness of the pixel density change, making the display effect of the entire terminal screen more inosculated and natural.

In addition, compared with the design of the transition region on the physical structure of the terminal screen, the embodiment of the present disclosure may provide a transition region in the first display region with higher pixel density at the software level, and the pixel density of the transition region may be controlled by software, thereby improving control flexibility.

The following are device embodiments of the present disclosure, which may be used to implement the method embodiments of the present disclosure. For details of the device embodiments, reference may be made to the method embodiments.

Figure 9:
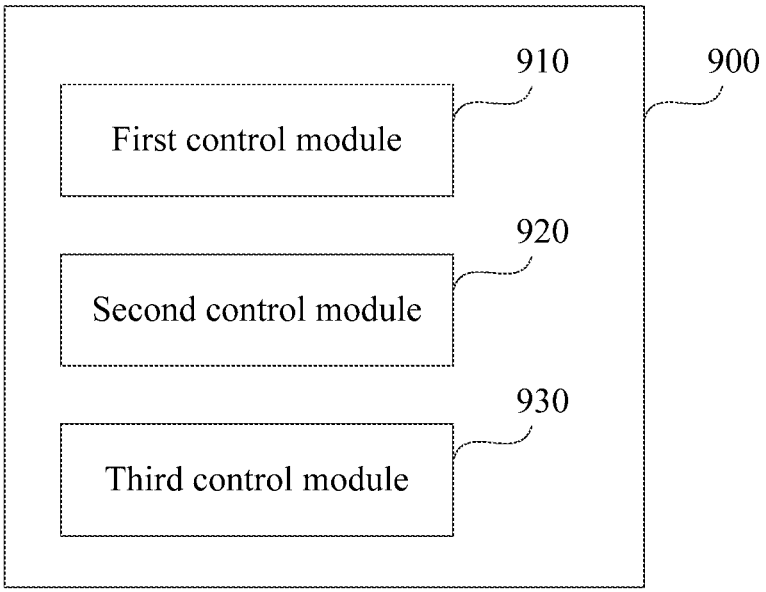
FIG. 9 is a block diagram of a display control device for a terminal screen according to an exemplary embodiment.

FIG. 9 is a block diagram of a display control device for a terminal screen according to an exemplary embodiment. The device has functions of implementing the above-described methods, and may be implemented by hardware or by hardware to execute corresponding software. The device may be the terminal described above or may be provided in the terminal. The terminal includes the terminal screen described above. As shown in FIG. 9, the device 900 can include: a first control module 910, a second control module 920, and a third control module 930.

The first control module 910 is configured to control a transition region in the first display region to be displayed according to a target pixel density, wherein the transition region is a neighboring region in the first display region and is adjacent to the second display region.

The second control module 920 is configured to control one or more regions in the first display region other than the transition region to be displayed according to a first pixel density.

The third control module 930 is configured to control the second display region to be displayed according to a second pixel density.

Wherein the target pixel density is smaller than the first pixel density and greater than the second pixel density.

In the embodiment, by providing the transition region in the first display region having a higher pixel density, the transition region, one or more regions in the first display region other than the transition region, and the second display region are controlled to be displayed according to the target pixel density, the first pixel density and the second pixel density, respectively, wherein the target pixel density is smaller than the first pixel density and greater than the second pixel density, such that the difference between the display effects caused by the difference in pixel densities between the first display region and the second display region can be effectively reduced, and the fusion of the display effects of the two display regions is improved, thereby making the overall display effect of the terminal screen better.

In an exemplary embodiment, the first control module 910 is configured to control n pixels in the transition region not to be displayed, wherein n is an integer greater than one.

In an exemplary embodiment, the n pixels are evenly distributed in the transition region.

In an exemplary embodiment, the transition region includes k sub-regions, and distances between the k sub-regions and the second display region are gradually increased, wherein k is an integer greater than one.

The first control module 910 is configured to control the k sub-regions to be displayed according to different pixel densities, wherein a pixel density of the i-th sub-region of the k sub-regions is smaller than a pixel density of the (i+1)th sub-region, and i is a positive integer smaller than k.

In an exemplary embodiment, the second display region is located at a notch portion formed at a side edge of the first display region; or the second display region is located at a notch portion formed at the middle of the first display region.

Figure 10:
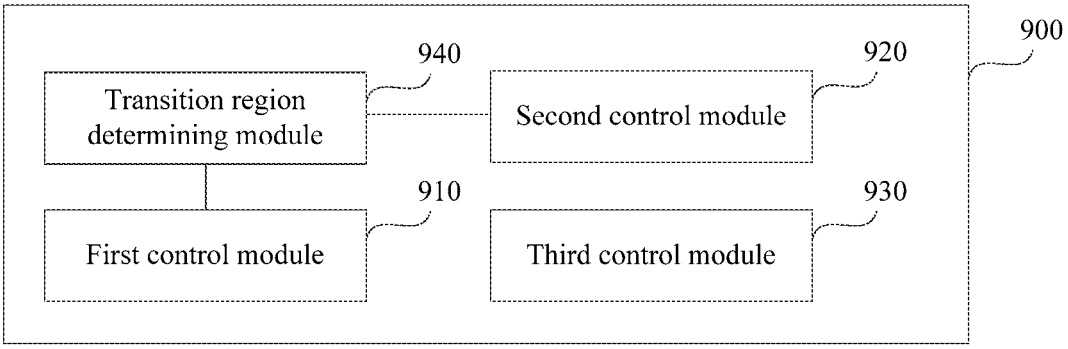
FIG. 10 is a block diagram of a display control device for a terminal screen according to an exemplary embodiment.

In an exemplary embodiment, shown in FIG. 10, the device 900 further includes a transition region determining module 940, configured to determine a size of the transition region according to a difference degree between content to be displayed in the first display region and content to be displayed in the second display region; wherein the size of the transition region is positively correlated with the difference degree.

It should be noted that the division of each functional module is only for illustrative purpose. In actual applications, the above functions may be distributed to different functional modules as needed, that is, the internal structure of the device may be divided into different functional modules to complete all or part of the functions described above.

With regard to the device in the above embodiments, the specific manner in which the respective modules perform the operations has been described in detail in the embodiments related to the method, and will not be repeated herein.

An exemplary embodiment of the present disclosure further provides a display control device for a terminal screen, which is capable of implementing the display control method for the terminal screen provided by the present disclosure. The device may be the terminal described above or may be provided in the terminal. The device includes a processor; and a memory for storing executable instructions for the processor, wherein the processor is configured to: control a transition region in the first display region to be displayed according to a target pixel density, wherein the transition region is a neighboring region in the first display region and is adjacent to a second display region; control one or more regions in the first display region other than the transition region to be displayed according to a first pixel density; and control the second display region to be displayed according to a second pixel density; wherein the target pixel density is smaller than the first pixel density and greater than the second pixel density.

In an exemplary embodiment, the processor is configured to: control n pixels in the transition region not to be displayed, wherein n is an integer greater than one.

In an exemplary embodiment, the n pixels are evenly distributed in the transition region.

In an exemplary embodiment, the transition region includes k sub-regions, and distances between the k sub-regions and the second display region are gradually increased, wherein k is an integer greater than one.

In an exemplary embodiment, the processor is configured to: control the k sub-regions to be displayed according to different pixel densities, wherein a pixel density of the i-th sub-region of the k sub-regions is smaller than a pixel density of the (i+1)th sub-region, and i is a positive integer smaller than k.

In an exemplary embodiment, the second display region is located at a notch portion formed at a side edge of the first display region; or the second display region is located at a notch portion formed at the middle of the first display region.

In an exemplary embodiment, the transition region includes a plurality of pixels surrounding the second display region.

In an exemplary embodiment, the processor is further configured to: determine a size of the transition region according to a difference degree between content to be displayed in the first display region and content to be displayed in the second display region; wherein the size of the transition region is positively correlated with the difference degree.

Figure 11:
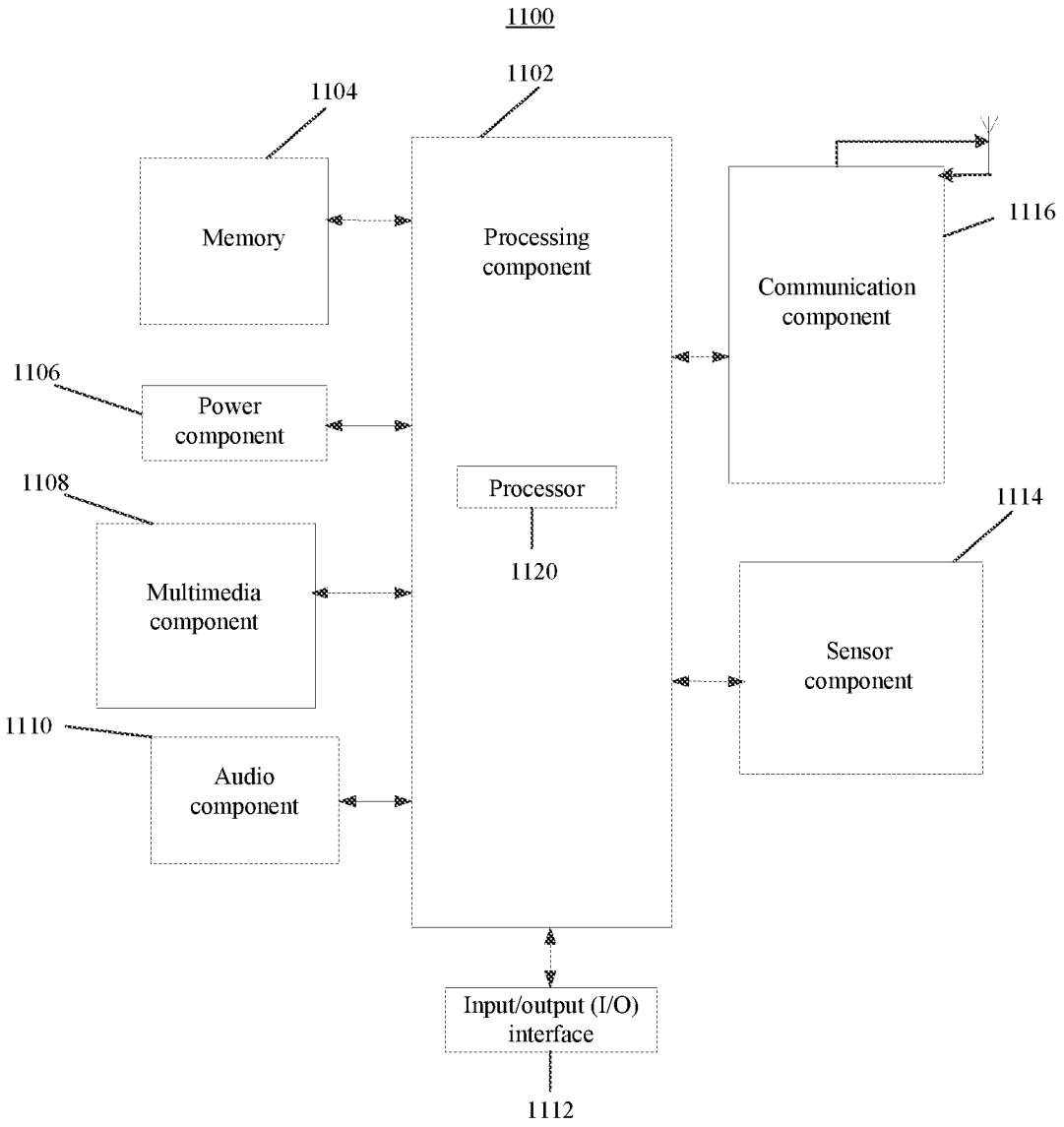
FIG. 11 is a block diagram of a display control device for a terminal screen according to an exemplary embodiment.

FIG. 11 is a block diagram of a device 1100 according to an exemplary embodiment. The device 1100 may be a mobile phone, a computer, a digital broadcasting device, a messaging device, a game console, a tablet device, a medical device, a fitness device, a personal digital assistant, etc. The device 1100 includes the terminal screen described above.

Referring to FIG. 11, the device 1100 may include one or more of the following components: a processing component 1102, a memory 1104, a power component 1106, a multimedia component 1108, an audio component 1110, an input/output (I/O) interface 1112, a sensor component 1114, and a communication component 1116.

The processing component 1102 typically controls the overall operations of the device 1100, such as the operations associated with display, telephone calls, data communications, camera operations, and recording operations. The processing component 1102 can include one or more processors 1120 to execute instructions to perform all or part of the steps in the above described methods. Moreover, the processing component 1102 can include one or more modules to facilitate the interaction between the processing component 1102 and other components. For example, the processing component 1102 can include a multimedia module to facilitate the interaction between the multimedia component 1108 and the processing component 1102.

The memory 1104 is configured to store various types of data to support the operation of the device 1100. Examples of such data include instructions for any application or method operated on device 1100, such as the contact data, the phone book data, messages, pictures, videos, and the like. The memory 1104 can be implemented by any type of volatile or non-volatile storage device, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 1106 provides power to various components of the device 1100. The power component 1106 can include a power management system, one or more power sources, and other components associated with the generation, management, and distribution of power in the device 1100.

The multimedia component 1108 includes a screen providing an output interface between the device 1100 and the user t. In some embodiments, the screen can include a liquid crystal display (LCD) and a touch panel (TP). If the screen includes the touch panel, the screen can be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some embodiments, the multimedia component 1108 includes a front camera and/or a rear camera. When the device 1100 is in an operation mode, such as a photographing mode or a video mode, the front camera and/or the rear camera can receive external multimedia data. Each of the front camera and the rear camera may be a fixed optical lens system or have focus and optical zoom capability.

The audio component 1110 is configured to output and/or input an audio signal. For example, the audio component 1110 includes a microphone (MIC) configured to receive an external audio signal when the device 1100 is in an operation mode, such as a call mode, a recording mode, and a voice recognition mode. The received audio signal may be further stored in the memory 1104 or sent via the communication component 1116. In some embodiments, the audio component 1110 also includes a speaker for outputting the audio signal.

The I/O interface 1112 provides an interface between the processing component 1102 and peripheral interface modules, such as a keyboard, a click wheel, buttons, and the like. These buttons may include, but are not limited to, a home button, a volume button, a starting button, and a locking button.

The sensor component 1114 includes one or more sensors for providing status assessments of various aspects of the device 1100. For example, the sensor component 1114 can detect an open/closed status of the device 1100, relative positioning of components, such as the display and the keypad of the device 1100. The sensor component 1114 can also detect a change in position of one component of the device 1100 or the device 1100, the presence or absence of user contact with the device 1100, an orientation, or an acceleration/deceleration of the device 1100, and a change in temperature of the device 1100. The sensor component 1114 can include a proximity sensor configured to detect the presence of nearby objects without any physical contact. The sensor component 1114 can also include a light sensor, such as a CMOS or CCD image sensor, configured to use in imaging applications. In some embodiments, the sensor component 1114 can also include an accelerometer sensor, a gyroscope sensor, a magnetic sensor, a pressure sensor, or a temperature sensor.

The communication component 1116 is configured to facilitate wired or wireless communication between the device 1100 and other devices. The device 1100 can access a wireless network based on a communication standard, such as WiFi, 4G or 5G, or a combination thereof. In an exemplary embodiment, the communication component 1116 receives broadcast signals or broadcast associated information from an external broadcast management system via a broadcast channel. In an exemplary embodiment, the communication component 1116 includes a near field communication (NFC) module to facilitate short-range communications. In an exemplary embodiment, the communication component 1116 can be implemented based on a radio frequency identification (RFID) technology, an infrared data association (IrDA) technology, an ultra-wideband (UWB) technology, a Bluetooth (BT) technology, and other technologies.

In an exemplary embodiment, the device 1100 may be implemented with one or more application specific integrated circuits (ASICs), digital signal processors (DSPs), digital signal processing devices (DSPDs), programmable logic devices (PLDs), field programmable Gate array (FPGA), controller, microcontroller, microprocessor or other electronic components.

In an exemplary embodiment, there is also provided a non-transitory computer-readable storage medium including instructions, such as a memory 1104 including instructions executable by the processor 1120 of the device 1100 to perform the above described methods. For example, the non-transitory computer readable storage medium may be a ROM, a random access memory (RAM), a CD-ROM, a magnetic tape, a floppy disc, and an optical data storage device.

Other embodiments of the present disclosure will be apparent to those skilled in the art from consideration of the specification and practice of the present disclosure disclosed herein. The present application is intended to cover any variations, uses, or adaptations of the present disclosure, which are in accordance with the general principles of the present disclosure and include common general knowledge or conventional technical means in the art that are not disclosed in the present disclosure. The specification and embodiments are illustrative, and the real scope and spirit of the present disclosure is defined by the appended claims.

It should be understood that the present disclosure is not limited to the precise structures that have been described above and shown in the drawings, and various modifications and changes can be made without departing from the scope thereof. The scope of the present disclosure is limited only by the appended claims.

What is claimed is:

1. A display control method for a terminal screen, wherein the terminal screen includes a display layer with an integrated structure, the display layer includes a first display region and a second display region, and a pixel density of the first display region is greater than a pixel density of the second display region, the method comprising:

controlling a transition region in the first display region to be displayed according to a target pixel density, wherein the transition region is a neighboring region in the first display region and is adjacent to the second display region, and the controlling includes controlling n pixels in the transition region not to be displayed, n being an integer greater than one;

controlling one or more regions in the first display region other than the transition region to be displayed according to a first pixel density; and controlling the second display region to be displayed according to a second pixel density, wherein the target pixel density is smaller than the first pixel density and greater than the second pixel density, and wherein the transition region includes k sub-regions, and distances between the k sub-regions and the second display region are gradually increased, k being an integer greater than one; and the controlling the transition region in the first display region to be displayed according to the target pixel density includes:

controlling the k sub-regions to be displayed according to different pixel densities, wherein a pixel density of an i-th sub-region of the k sub-regions is smaller than a pixel density of an (i+1)th sub-region, i being a positive integer smaller than k.

2. The method according to claim 1, wherein the n pixels are evenly distributed in the transition region.

3. The method according to claim 1, wherein:

the second display region is located at a notch portion formed at a side edge of the first display region or at the middle of the first display region.

4. The method according to claim 1, further comprising:

determining a size of the transition region according to a difference degree between content to be displayed in the first display region and content to be displayed in the second display region, wherein the size of the transition region is positively correlated with the difference degree.

5. A display control device for a terminal screen, wherein the terminal screen includes a display layer with an integrated structure, the display layer includes a first display region and a second display region, and a pixel density of the first display region is greater than a pixel density of the second display region, the device comprising:

a processor; and a memory for storing instructions executable by the processor;

wherein the processor is configured to:

control a transition region in the first display region to be displayed according to a target pixel density, wherein the transition region is a neighboring region in the first display region and is adjacent to the second display region, and controlling the transition region includes controlling n pixels in the transition region not to be displayed, n being an integer greater than one;

control one or more regions in the first display region other than the transition region to be displayed according to a first pixel density; and control the second display region to be displayed according to a second pixel density, wherein the target pixel density is smaller than the first pixel density and greater than the second pixel density, and wherein the transition region includes k sub-regions, and distances between the k sub-regions and the second display region are gradually increased, k being an integer greater than one; and the processor is further configured to:

control the k sub-regions to be displayed according to different pixel densities, wherein a pixel density of an i-th sub-region of the k sub-regions is smaller than a pixel density of an (i+1)th sub-region, and i is a positive integer smaller than k.

6. The device according to claim 5, wherein the n pixels are evenly distributed in the transition region.

7. The device according to claim 5, wherein:

the second display region is located at a notch portion formed at a side edge of the first display region or at the middle of the first display region.

8. The device according to claim 5, wherein the processor is further configured to:

determine a size of the transition region according to a difference degree between content to be displayed in the first display region and content to be displayed in the second display region, wherein the size of the transition region is positively correlated with the difference degree.

9. A non-transitory computer-readable storage medium having stored thereon a computer program that, when executed by a processor of a device, causes the device to perform a display control method for a terminal screen, wherein the terminal screen includes a display layer with an integrated structure, the display layer includes a first display region and a second display region, and a pixel density of the first display region is greater than a pixel density of the second display region, the method comprising:

controlling a transition region in the first display region to be displayed according to a target pixel density, wherein the transition region is a neighboring region in the first display region and is adjacent to the second display region, and the controlling includes controlling n pixels in the transition region not to be displayed, n being an integer greater than one;

controlling one or more regions in the first display region other than the transition region to be displayed according to a first pixel density; and controlling the second display region to be displayed according to a second pixel density, wherein the target pixel density is smaller than the first pixel density and greater than the second pixel density, and wherein the transition region includes k sub-regions, and distances between the k sub-regions and the second display region are gradually increased, k being an integer greater than one; and the controlling the transition region in the first display region to be displayed according to the target pixel density includes:

controlling the k sub-regions to be displayed according to different pixel densities, wherein a pixel density of an i-th sub-region of the k sub-regions is smaller than a pixel density of an (i+1)th sub-region, i being a positive integer smaller than k.

* * * * *